United States Patent [19]

Gavin

[11] Patent Number: 4,838,731

[45] Date of Patent: Jun. 13, 1989

[54] SEPTIC TANK DISTRIBUTION BOX SYSTEM

[76] Inventor: Norman Gavin, 2545 Ridge Rd., North Haven, Conn. 06473

[21] Appl. No.: 92,764

[22] Filed: Sep. 3, 1987

[51] Int. Cl.[4] ..... E02B 11/00; B01D 21/02

[52] U.S. Cl. ..... 405/40; 137/408; 210/532.2; 405/36

[58] Field of Search ..... 405/36, 39, 40, 92, 405/93; 137/408; 210/170, 532.2

[56] References Cited

U.S. PATENT DOCUMENTS

| | | | |
|---|---|---|---|
| 91,828 | 6/1869 | Dark | 137/240 |
| 275,803 | 4/1883 | Collings et al. | 4/220 |
| 317,025 | 5/1885 | Scott | 137/408 |
| 412,965 | 10/1889 | Mastick | 137/408 |
| 545,566 | 9/1896 | Wrigley | 4/313 |
| 635,206 | 10/1899 | Taylor | 405/93 |
| 648,312 | 4/1900 | Taylor | 405/93 |
| 670,888 | 3/1901 | Ridgway | 405/93 |
| 710,209 | 9/1902 | Pratt | 137/408 |
| 931,481 | 8/1909 | Pratt | 137/408 |
| 1,644,532 | 10/1927 | Ledyard et al. | 210/532.2 X |
| 3,698,194 | 10/1972 | Flynn | 405/36 |
| 4,303,350 | 12/1981 | Dix | 405/36 |

FOREIGN PATENT DOCUMENTS

| | | | |
|---|---|---|---|
| 1161643 | 6/1985 | U.S.S.R. | 405/39 |

*Primary Examiner*—David H. Corbin

*Attorney, Agent, or Firm*—Pasquale A. Razzano

[57] ABSTRACT

A system for leaching septic effluent is disclosed which includes a concrete distribution box having inlet and outlet openings formed therein located at different levels. An open-topped tray pivotally mounted in the distribution box at a level located between the levels of the inlet and outlet openings and has a counterweight secured to one side side of its pivotal mounting and a first stop to maintain the tray in a horizontal position against the action of the counterweight when the tray is empty. The tray is located to receive effluent from the inlet opening and the counterweight is dimensioned to be overcome by effluent in the tray when a predetermined amount of effluent is in the tray. As a result, the tray pivots against the influence of the counterweight away from its first stopped position to empty the tray and discharge the predetermined amount of effluent to the outlet openings. A second stop is formed in the box to limit pivotal movement of the tray away from the first stopped position to a predetermined effluent emptying position.

8 Claims, 6 Drawing Sheets

SEPTIC TANK DISTRIBUTION BOX SYSTEM

This application relates to an improved method for the distribution of effluent after exiting a septic tank, in a manner that promotes uniform application to various types of leaching systems.

BACKGROUND OF THE INVENTION

At the present time, effluent discharged from septic tanks is commonly applied to leaching systems utilizing gravity flow. This effluent is generally directed through standard distribution boxes and applied to leaching systems in one of several manners. The leaching systems are laid out so that the liquid is applied to the soil some distance from the tank for dispersal by trenches, beds, pits, galleries or other land application methods. Normal flows through septic tanks typically cause liquid to discharge at a very slow rate of flow, sometimes referred to as "trickle" flow. This is due to the quelling effect of the large liquid filled septic tank which is barely impacted by frequent applications of small discharges generated by residential and commercial water use fixtures.

The present invention is significantly different from previously proposed methods of effluent application because it provides a cost effective means for applying effluent to several separate leaching areas or systems by dosing 2.3 gallons of liquid in a distribution box with multiple outlets. This is far superior to standard gravity flow for leaching systems constructed on both level areas and on slopes. Gravity flow to leaching systems in level areas is normally achieved through a distribution box with all pipes set at the same elevation. Liquid entering the box has a tendency to flow out the lowest pipe even if the difference in elevation is minimal, as little as 1/16 of an inch. The result is disproportionate effluent loading which may saturate the soil in one small portion of the system area. After total saturation, liquid may back up into the distribution box and be redirected to the next lowest pipe in the box but continue to overload that lowest receiving leaching system. The present invention eliminates this unequal loading situation by collecting small batches of liquid which are then automatically dumped within the distribution box in such a manner to equally distribute effluent to selected leaching components. Slight differences in pipe elevations, possible settling of the distribution box, actions of the frost/thaw cycle or different angles of piping entering the box are compensated for each time the invention forcefully dumps the collected liquid within the sump area of the box.

The beneficial applications for use of the present invention are even greater when used for leaching systems installed at different elevations. It has long been recognized that serial application of effluent to leaching systems was preferable to central distribution box division, not because systems worked better under flooded conditions, but because health officials, engineers and installers were aware of the many problems involved with trying to install and maintain equal flow division in a standard distribution box. One method to avoid that problem was to apply effluent in such a manner so as to flood the upper leaching area until effluent backed up to the overflow elevation. This disproportionate effluent distribution system did not promote uniform use of leaching areas but did assure complete use of the system through a series of overflows. Use of the present invention instead of serial application will allow 100% utilization of leaching systems not located in the same area or at the same elevation. Uniform application of effluent over a larger area is preferable to over saturation of leaching systems.

OBJECTS OF THE INVENTION

It is therefore an object of the present invention to provide an improved method of distributing effluent.

A further object of the invention is to provide a system wherein the cost is materially below that of competing systems.

The cost reduction is realized through use of a distribution box to replace the first distribution box typically used for both level and sloped leaching system installations. The dosing effect achieved through use of the present invention is normally provided by either using mechanical pump lift stations, which are expensive to both operate and install, or installation of a dosing siphon chamber, which is also much more expensive than the present invention and normally requires an 18 to 24 inch head loss to operate. The present invention effectively provides small batch dosing within the distribution box with only an 8 inch difference between the inlet and outlet.

BRIEF DESCRIPTION OF THE INVENTION

The present invention includes a distribution box consisting of a precast concrete distribution box specifically designed to house a pivoted tray and insure equal division of effluent to four outlet openings in the end walls of the concrete box. These openings may be formed using a pipe seal as described in U.S. patent application Ser. No. 858,341, filed May 1, 1986 (the disclosure of which is incorporated by reference) which permits easy access for multiple pipe connection with a water tight seal for both 3 and 4 inch diameter piping used for septic system construction. The tray is of one-piece PVC construction which pivots within the box to achieve the desired dosing effect each time the tray is loaded with a predetermined amount of effluent required to activate the dump. The tray rotates back and forth on durable PVC rocker hinges which are an integral part of the tray and which are set on PVC sockets that are cast into the concrete box floor. A small quantity of concrete is cast to the underside of the tray to act as a counterbalance, returning the tray to the receiving position immediately after the dump occurs. The material used to construct the tray has been specifically designed and tested to withstand the various chemicals and compounds typically discharged into septic systems.

FIG. 1*a* is a side sectional view of a distribution box containing a distribution tray and constructed in accordance with the, present invention;

FIG. 1*b* is a sectional view taken along line 1*b*—1*b* of FIG. 1*a;*

FIG. 2*a* is a side sectional view similar to FIG. 1 *a* showing the distribution tray being filled;

FIG. 2*b* is a side sectional view taken along line 2*b*—2*b* of FIG. 2*a;*

FIG. 3*a* is a side sectional view similar to FIG. 1*a* showing the tray as it is approaching complete filling and about to pivot to its emptying position;

FIG. 3*b* is a side sectional view taken along line 3*b*—3*b* of FIG. 3*a;*

FIG. 4*a* is a side sectional view similar to FIG. 1*a* showing the distribution tray in its emptying position;

FIG. 4*b* is a sectional view taken along line 4*b*—4*b* of FIG. 4*a;*

FIG. 5*a* is a side view of the distribution tray used in the apparatus of FIGS. 1–4;

FIG. 5*b* is a top plan view of the distribution tray;

FIG. 5*c* is a rear view of the distribution tray of FIG. 5*a;*

FIG. 6*a* is a side sectional view of the distribution both used in the device illustrated in FIGS. 1–4;

FIG. 6*b* is a sectional view taken along line 6*b*–6*b* of FIG. 6*1;*

FIG. 6*c* is a sectional view taken along line 6*c*–6*c* of FIG. 6*a;*

Figure 9A:
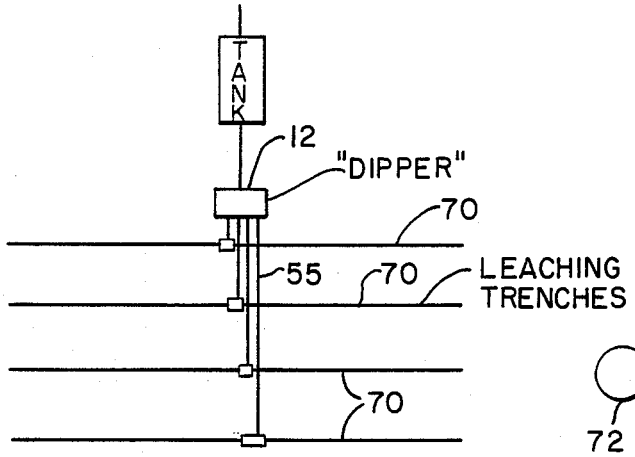
Figure 9B:
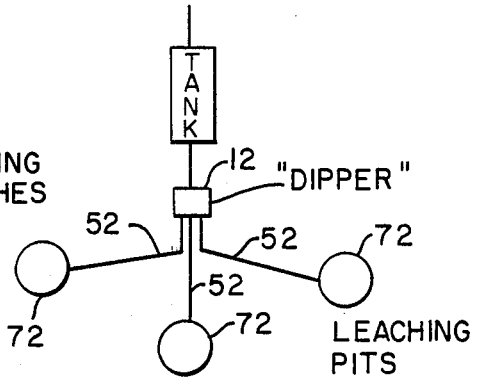
Figure 9C:
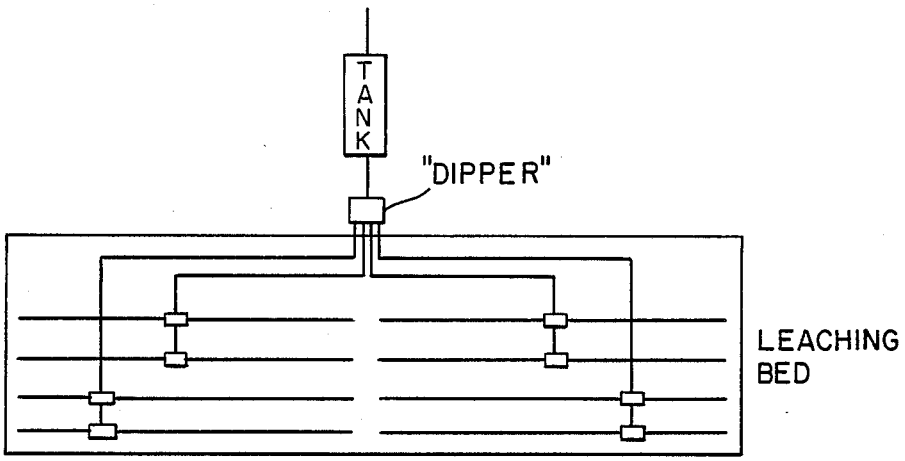
Figure 9D:
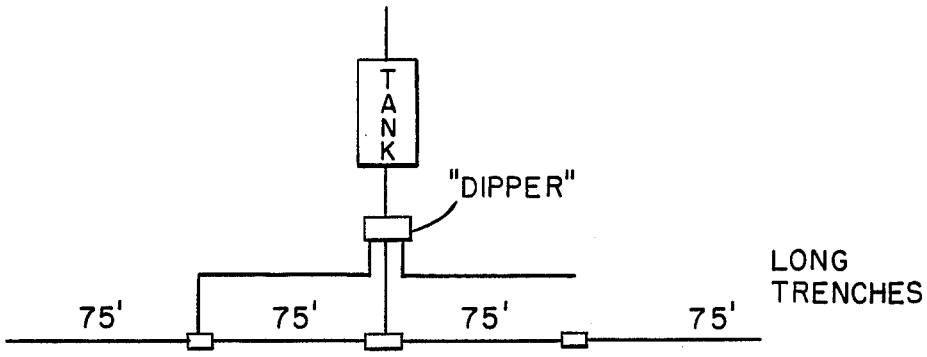
Figure 10E:
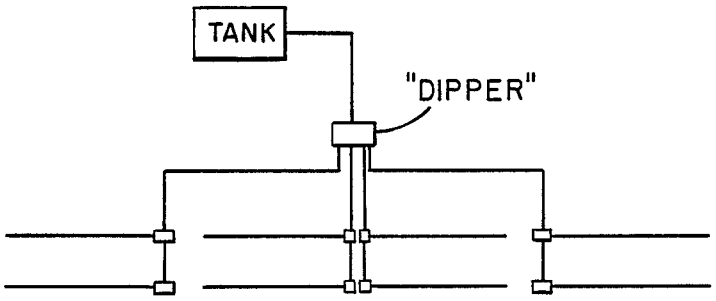
Figure 10A:
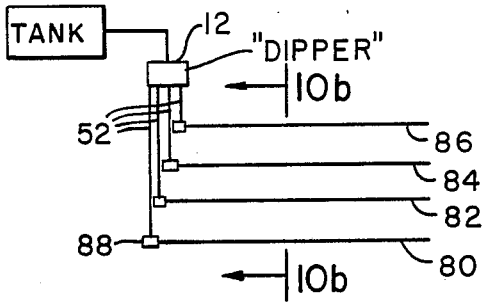
Figure 10B:
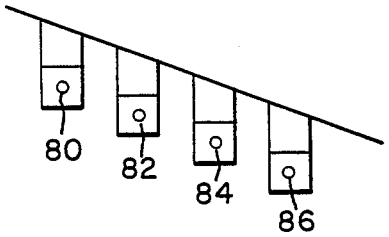

FIG. 9*a* is a schematic illustration of the system of the present invention adapted to a level leaching trench field;

FIG. 9*b* is a schematic illustration demonstrating the adaptation of the present invention to a level leaching pit field;

FIG. 9*c* is a schematic illustration of the adaptation of the present invention to a level leaching bed field;

FIG. 9*d* is a schematic illustration of the adaptation of the present invention to a long leaching trench field;

FIG. 10*a* is a schematic illustration of the adaptation of the preset invention to a sloped leaching trench field;

FIG. 10*b* is a schematic side view taken along line 10*b*—10*b* of FIG. 10*a*.

Figure 10C:
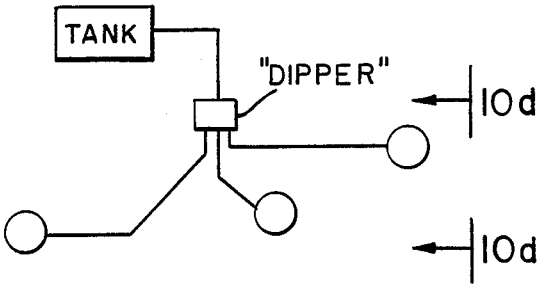
Figure 10D:
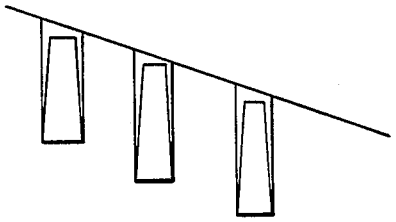

FIG. 10*c* is a schematic illustration of the apparatus of the present invention to a sloped leaching pit field; and FIG. 10*d* is a schematic side view taken along line 10*d*—10*d* of FIG. 10*c*.

FIG. 10*e* is a schematic illustration of the apparatus of the present invention to another leaching field.

Referring now to the drawings in detail, and initial to FIGS. 1–4 thereof, the leaching septic effluent distribution system 10 of the present invention is illustrated. This system includes a concrete distribution box 12 having four sides (including an inlet side 14 and an opposed outlet side 16) and a base 18. The distribution box is closed by a removable top 20. As will be understood by those skilled in the art, an effluent distribution box is intended to be buried underground.

The inlet side 14 of the box 12 has an opening 22 formed therein which is adapted to receive an effluent inlet pipe 24. The opening 22 is preferably formed by a seal lock arrangement, such as is disclosed in U.S. patent application Ser. No. 858,341, filed May 1, 1986 the disclosure of which is disclosed herein by reference. The inlet pipe which is received in the opening 22 transfers effluent from a septic tank into the distribution tank. As will also be understood by those skilled in the art, a septic tank receives waste discharges from a home or the like and fills with liquid and waste. Near the top of the septic tank an opening is provided for discharge of liquid to the pipe 24 in a trickle-like manner. This effluent is passed through the outlet pipe 52 to a leach field, where the liquid drains into the ground. In accordance with the present invention, the distribution box 12 is designed and constructed in order to insure uniform distribution of this effluent throughout the leach field.

Figure 5A:
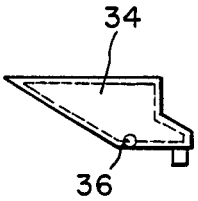
Figure 5B:
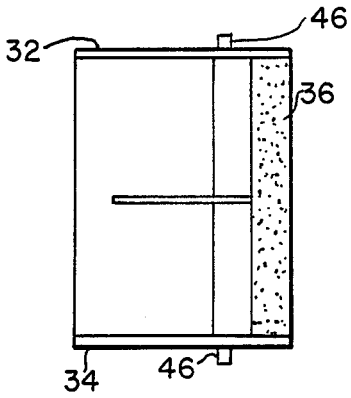
Figure 5C:
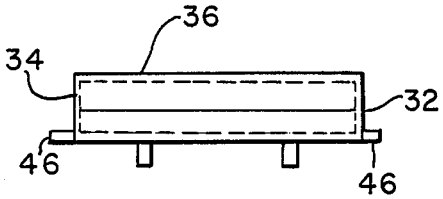
Figure 6A:
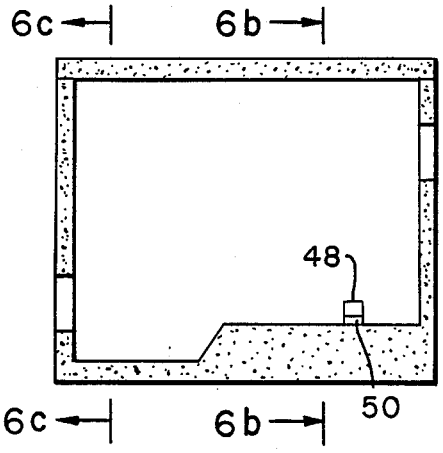
Figure 6B:
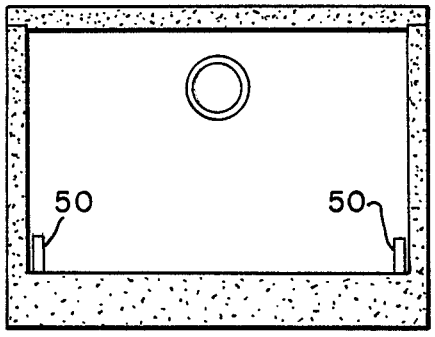
Figure 6C:
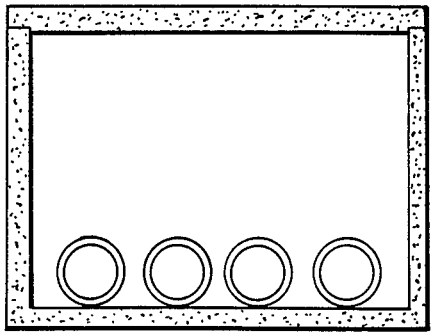
Figure 7:
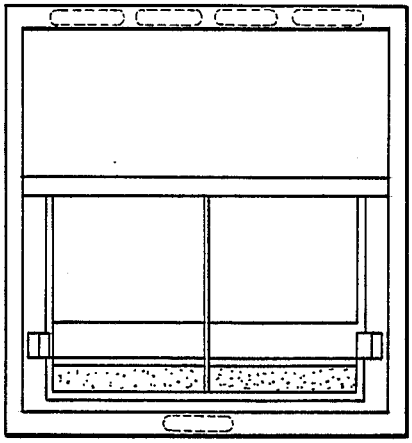
FIG. 7 is a sectional view taken along line 7—7 of FIG 1*a;*

The distribution box 12 includes a distribution tray 26 pivotally mounted therein. This tray is generally rectangular in plan view, as seen in FIG. 5*b*, and has an open top 28, a bottom wall 30, and three side walls 32, 34 and 36. The bottom wall 30 includes a sloped forward end 38.

The distribution tray 26 is preferably formed of a plastic material such as polyethylene or polyvinyl chloride. It includes a rear shelf or extension 40 in which concrete or other heavy material can be permanently placed, to form a counterweight for the tray, as seen in FIGS. 5*a* and 5*b*. This extension includes a pair of stops or feet 42 integrally formed thereon and extending downwardly therefrom for engagement with the upper surface 44 of the concrete bottom wall 18.

The side walls 32 and 34 of tray 26 include integral outwardly extending pivot pins 46 for pivotally mounting the tray within the distribution box. These pins are received in upwardly opening curved sockets 48 formed in PVC sockets 50 cast in place in the floor 18 of the box 12. These sockets permit pivotal movement of the tray 28 during operation of the device.

Figure 1A:
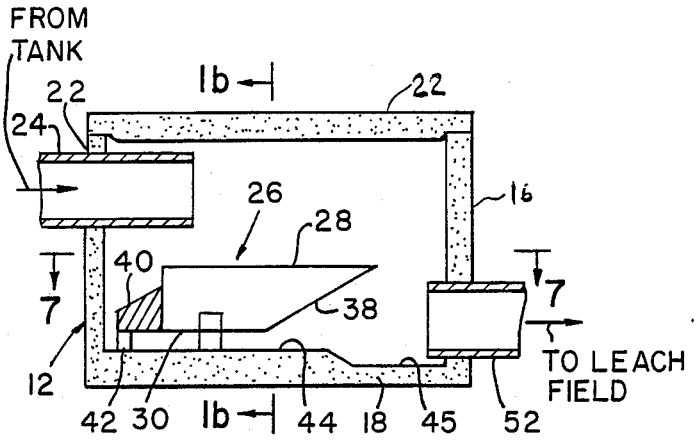
Figure 1B:
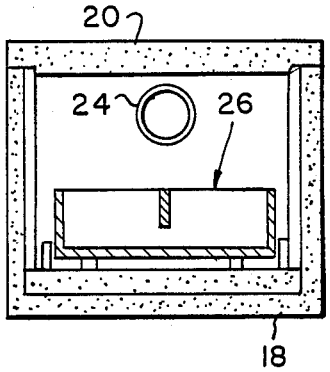
Figure 2A:
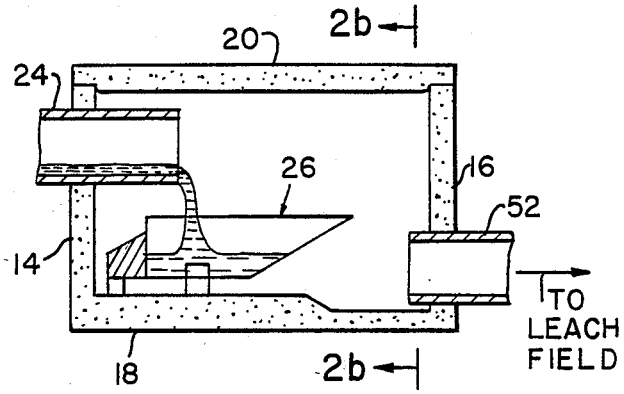
Figure 2B:
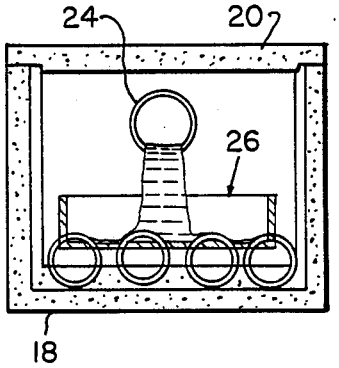
Figure 3A:
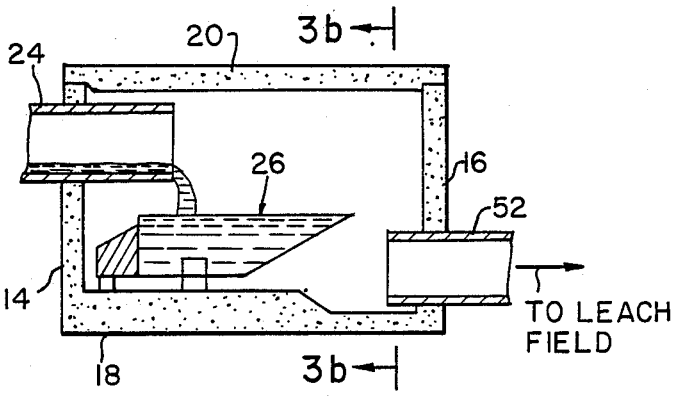
Figure 3B:
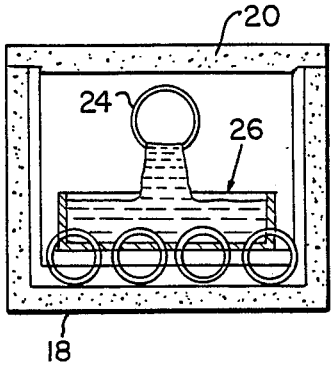
Figure 4A:
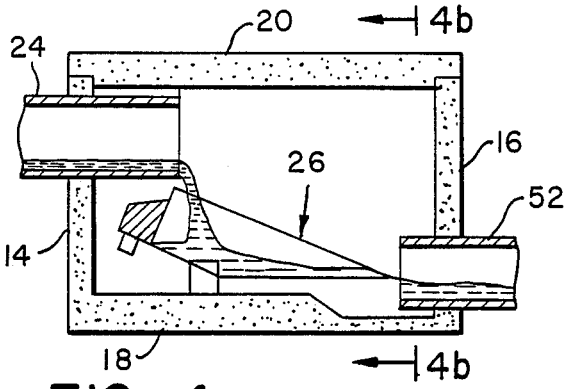
Figure 4B:
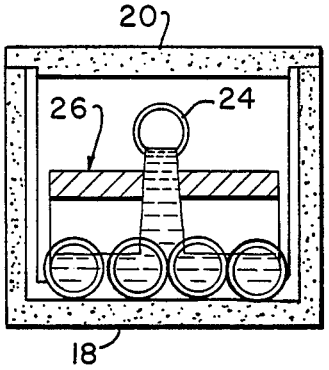

As seen in FIGS. 1*a*–4*a*, the upper surface 44 of the bottom wall 18 of box 12 is relatively flat and when the tray pivots from the position shown in FIGS 1*a*–3*a* to the discharge position shown in FIG. 4*a*, the surface 44 of the bottom wall 18 cooperates with the section 38 of the bottom of tray 26 to define a second stopped or effluent discharge position. In this position the effluent in the tray is deposited in a depressed or sump area 45 formed in the bottom wall of the box 12.

In the illustrative embodiment of the present invention, a series of discharge or outlet pipes 52 are provided in the outlet wall 16. These pipes may be mounted in the wall through cast-in-place seals as described in the above-described U.S. patent application. In the illustrative embodiment shown in FIGS. 1–6 four such discharge pipes are provided. These pipes are located so that their inlet ends communicate with the sump 45 below the level of surface 44 so as to insure that a substantially equal amount of effluent from the tray is received in each pipe.

In accordance with the present invention, the counterweight cast in the extension 40 is dimensioned in order to normally hold the tray 28 in its horizontal position shown in FIGS. 1*a*–3*a* where it is located between the level of the inlet pipe 24 and the outlet pipes 52, but in a position to receive effluent from the inlet pipe 24, as seen in FIG. 2*a*. As effluent collects in the tray, from the trickle outlet effect of the septic tank, the tray fills, as seen in FIG. 3*a*, until a predetermined amount of liquid (preferably about 2.3 gallons) substantially fills the tray and overcomes the effect of the counterbalance attached thereto. This causes the tray to pivot from its receiving position, shown in FIG. 3*a*, to its outlet position, shown in FIG. 4*a*. In this position the effluent is discharged into the small sump section 45 formed in the bottom wall of the box 12 where it can pass in a relative even distribution between the four discharge pipes. Since a relatively large quantity of effluent is supplied to the sump at one time, even if the discharge pipes are not all exactly at the same level, the effluent will be reasonably evenly distributed therebetween. This will insure that the effluent is distributed evenly to the various sections of the leach field. This overcomes the problems of previously proposed arrangements wherein one section of the leach field may receive more effluent than the others and become flooded.

Figure 8:
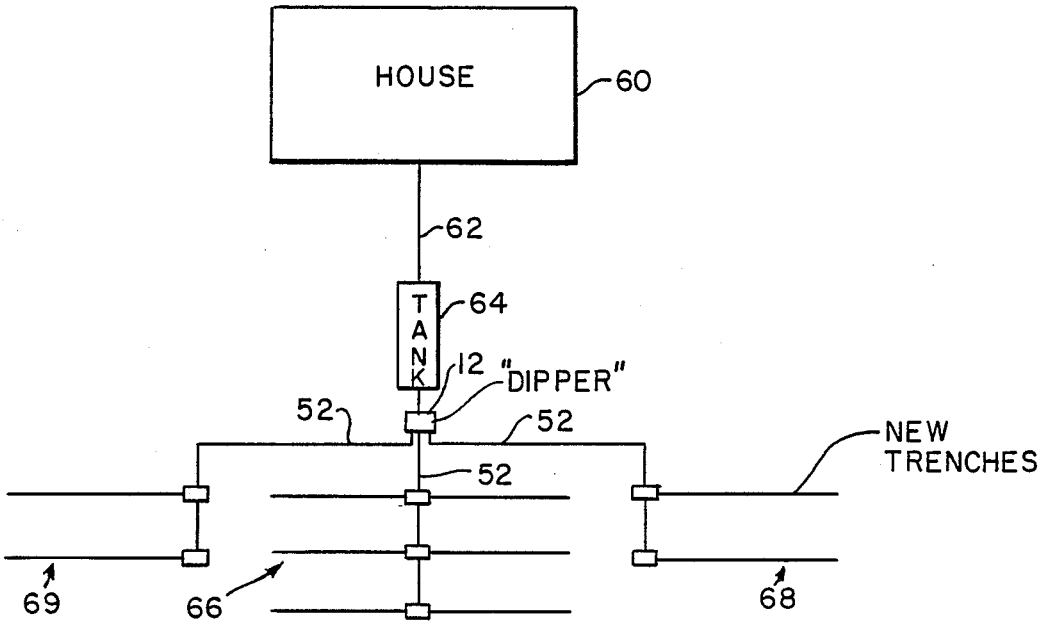
FIG. 8 is a schematic illustration demonstrating the arrangement of the system of the present invention adapted to a pre-existing leach field.

Referring now to FIG. 8, a schematic diagram is provided to illustrate how the present invention might be adapted to an existing leach field system. As seen therein, waste discharge from a house 60 is passed in a conventional manner through a line 62 to the septic tank 64. As discussed above, in conventional existing systems effluent seeps from an upper discharge pipe in the septic tank to a pre-existing leach field 66. Because of differences of levels in the various pipes set in the leach field, it is possible with previously proposed systems that one segment of the field will be flooded before effluent passes to other segments of the field. In accordance with the present invention, a distribution box 12 containing a pivoted distribution tray 26, as described above, is connected to the outlet of the septic tank 64. New leach fields 68,69 are formed adjacent the old field 66 and connected to the outlet openings of the distribution box through pips 52, as described above. The old leach field is also connected to the distribution box by a pipe 52.

FIG. 9*a* illustrates a system in which leaching trenches rather than a leaching pipe field is provided with each of the underground trenches 70 being connected by outlet pipes 52 to the distribution box 12. FIG. 9*b* illustrates a system wherein leaching pits 72 are provided connected by pipes 52 to the distribution box 12. Again, in each of these embodiments, the provision of the distribution tray of the invention insures uniform distribution of liquid to the pipes 52. Another embodiment wherein an enlarged leaching bed is provided is illustrated in FIG. 9*c*; while FIG. 9*d* illustrates an embodiment in which a single long leaching trench is provided.

FIG. 10*a* illustrates a leach field system wherein the field is located on a slope with each of the leaching pipes 80–86 being located on a different level. In this case the outlet pipes 52 are all located on the same level at their connection to distribution box 12 and then slope downwardly to the junction boxes 88 to which leach pipes 80–86 are connected. In this way all of the leach pipes are provided equally with effluent at box 12, although the leach pipes 80–86 are located themselves on different levels.

FIGS. 10*c* and 10*d* illustrate a similar construction wherein leach pits are used.

Although illustrative embodiments of the present invention have been illustrated herein in connection with the accompanying drawings, it is to be understood that the invention is not limited to those precise embodiments and that various changes and modifications may be effected therein by those skilled in the art without departing from the scope of the present invention.

What is claimed is:

1. A system for periodically discharging a predetermined amount of septic effluent into a leaching field comprising a distribution box having an inlet opening and a plurality of outlet openings formed therein, said outlet openings being located at a level in said box below the level at which said inlet opening is located, an open-topped tray pivotally mounted in said distribution box at a level located between levels of said inlet and outlet openings in said box, said tray having an effective capacity approximately equal to said predetermined amount, a counterweight secured to said tray on one side of the pivotal mounting thereof and a first stop means for maintaining said tray in a horizontal position, against the action of the counterweight, when said tray is empty, said tray being located to receive effluent from said inlet opening and said counterweight being dimensioned to be overcome by effluent is in the tray when said predetermined amount of effluent is in the tray where by the tray pivots against the influence of the counter weight away from said first stop to empty the tray and discharge said predetermined amount of effluent to said outlet pivotal movement of the tray away from the first stop to a predetermined effluent emptying position, each of said outlet openings being located at approximately the same level so that effluent periodically discharged from said tray will enter said outlet openings substantially simultaneously.

2. A system as defined in claim 1, wherein said tray has a sloping bottom wall and said distribution box has a bottom wall; said second stop comprising a section of the bottom wall of the distribution box.

3. A system as defined in claim 2, wherein said tray is formed of PVC plastic.

4. A system as defined in claim 3, wherein said tray has integral pivot pins formed thereon.

5. A system as defined in claim 4, wherein said first stop means are formed on said tray.

6. A system as defined in claim 5, including means formed of PVC plastic cast in place in said box for pivotally receiving the pivot pins on said tray.

7. A system as defined in claim 1, wherein said effluent emptying position of the tray is located above the outlet opening in the distribution box.

8. A system as defined in claim 7, wherein said distribution box has a bottom wall having a sump formed therein for recovering effluent from the tray and said outlet opening communicates with said sump.

* * * * *